US011892213B2

(12) United States Patent
Ren et al.

(10) Patent No.: US 11,892,213 B2
(45) Date of Patent: Feb. 6, 2024

(54) MULTI-CONNECTION AIR CONDITIONING SYSTEM AND METHOD FOR CALCULATING HEAT EXCHANGE AMOUNT THEREOF

(71) Applicants: Qingdao Haier Air-conditioning Electronic Co., Ltd, Qingdao (CN); Haier Smart Home Co., Ltd., Qingdao (CN)

(72) Inventors: Tao Ren, Qingdao (CN); Qiang Song, Qingdao (CN); Yinyin Li, Qingdao (CN); Jingsheng Liu, Qingdao (CN); Bing Wang, Qingdao (CN)

(73) Assignees: Qingdao Haier Air-conditioning Electronic Co., Ltd, Qingdao (CN); Haier Smart Home Co., Ltd., Qingdao (CN)

( * ) Notice: Subject to any disclaimer, the term of this patent is extended or adjusted under 35 U.S.C. 154(b) by 793 days.

(21) Appl. No.: 16/970,441

(22) PCT Filed: Dec. 24, 2019

(86) PCT No.: PCT/CN2019/127941
§ 371 (c)(1),
(2) Date: Aug. 17, 2020

(87) PCT Pub. No.: WO2020/238183
PCT Pub. Date: Dec. 3, 2020

(65) Prior Publication Data

US 2023/0089608 A1 Mar. 23, 2023

(30) Foreign Application Priority Data

May 24, 2019 (CN) ..... 201910441905.5

(51) Int. Cl.
*F25B 49/02* (2006.01)

(52) U.S. Cl.
CPC ..... *F25B 49/02* (2013.01); *F25B 2313/0314* (2013.01); *F25B 2500/19* (2013.01); *F25B 2700/13* (2013.01)

(58) Field of Classification Search
CPC ..... F25B 49/02; F25B 2313/0314; F25B 2500/19; F25B 13/00; F25B 2313/0231;
(Continued)

(56) References Cited

U.S. PATENT DOCUMENTS 11,060,779 B2 * 7/2021 Takenaka ..... F25B 25/005
2013/0067944 A1 * 3/2013 Kibo ..... F24F 11/56 62/157

(Continued)

FOREIGN PATENT DOCUMENTS

CN 1344921 A 4/2002
CN 107143979 A 9/2017

(Continued)

OTHER PUBLICATIONS

International Search Report dated Mar. 13, 2020 in corresponding International application No. PCT /CN2019/127941; 8 pages.

*Primary Examiner* — Jeffrey P Aiello
(74) *Attorney, Agent, or Firm* — Maier & Maier, PLLC

(57) ABSTRACT

A multi-connection air conditioning system and a method for calculating a heat exchange amount thereof includes a plurality of indoor units, and the method includes: obtaining a total heat exchange amount of the multi-connection air conditioning system; obtaining inlet air temperature of each indoor unit; obtaining a two-phase saturation temperature of each indoor unit; obtaining an air supply volume of each indoor unit; obtaining a heat exchange area of each indoor unit; and calculating a heat exchange amount of each indoor unit according to the total heat exchange amount of the multi-connection air conditioning system, the inlet air temperature of each indoor unit, the two-phase saturation tem- (Continued)

perature of each indoor unit, the air supply volume of each indoor unit, and the heat exchange area of each indoor unit. Thus the user can monitor the heat exchange amount of each indoor unit so that they can be managed with separate targets.

10 Claims, 2 Drawing Sheets

(58) Field of Classification Search
CPC ..... F25B 2600/21; F25B 2313/02741; F25B 2400/121; F25B 25/005; F25B 2700/1933; F25B 2700/21173; F24F 11/30; F24F 11/63; F24F 2110/10; F24F 2140/12; F24F 2140/20; F24F 3/065; F24F 11/46; F24F 11/56; G05B 2219/2614; G05B 15/02
USPC ..... 62/117, 126–127, 129, 160; 702/51, 702/188–189
See application file for complete search history.

(56) References Cited

U.S. PATENT DOCUMENTS

| | | | | |
|---|---|---|---|---|
| 2015/0027147 | A1* | 1/2015 | Cur | F25B 49/02 62/126 |
| 2015/0034293 | A1* | 2/2015 | Takayama | F24F 11/54 165/207 |
| 2017/0198945 | A1* | 7/2017 | Azuma | F24F 11/89 |

FOREIGN PATENT DOCUMENTS

| | | | | |
|---|---|---|---|---|
| CN | 107514759 | A | 12/2017 | |
| CN | 107702292 | A | 2/2018 | |
| CN | 108050645 | A | 5/2018 | |
| CN | 108344528 | A | 7/2018 | |
| CN | 110260452 | A | 9/2019 | |
| JP | 6004228 | B2 | 10/2016 | |
| WO | WO-2015013603 | A1 * | 1/2015 | F24F 1/0003 |

* cited by examiner

MULTI-CONNECTION AIR CONDITIONING SYSTEM AND METHOD FOR CALCULATING HEAT EXCHANGE AMOUNT THEREOF

FIELD

The present disclosure belongs to the technical field of air conditioning, and in particular relates to a multi-connection air conditioning system and a method for calculating a heat exchange amount thereof.

BACKGROUND

With the continuous improvement of people's living standards, higher and higher requirements have been raised by people on the living environment. In order to maintain a comfortable ambient temperature in medium and large places, a multi-connection air conditioning system has become an indispensable heat exchange device. Specifically, most existing multi-connection air-conditioning systems are composed of one outdoor unit and a plurality of indoor units. In order to facilitate users to manage the operation of a plurality of indoor units, a heat exchange amount of each of the indoor units is often required to be monitored separately in the multi-connection air-conditioning system. There are many methods for calculating the heat exchange amount in the related art, but most of these methods for calculating the heat exchange amount are only applicable to an air conditioner composed of one indoor unit and one outdoor unit. It is impossible to calculate the heat exchange amount of each indoor unit separately in the multi-connection air-conditioning system. In recent years, in some methods for calculating the heat exchange amount, it is also possible to calculate the heat exchange amount of each indoor unit in the multi-connection air conditioning system separately; however, these calculation methods all rely on measuring a temperature change amount of heat exchange water to achieve the calculation of the heat exchange amount, that is, these calculation methods are only applicable to water-cooled multi-connection air conditioning systems, and cannot calculate the heat exchange amount of each indoor unit in air-cooled multi-connection air conditioning systems.

Accordingly, there is a need in the art for a new multi-connection air conditioning system and a method for calculating a heat exchange amount thereof to solve the above problem.

SUMMARY

In order to solve the above-mentioned problem in the related art, that is, to solve the problem that the existing methods for calculating a heat exchange amount cannot calculate a heat exchange amount of each indoor unit of an air-cooled multi-connection air conditioning system separately, the present disclosure provides a method for calculating a heat exchange amount of a multi-connection air conditioning system, wherein the multi-connection air conditioning system includes a plurality of indoor units, and the method for calculating the heat exchange amount includes: obtaining a total heat exchange amount of the multi-connection air conditioning system; obtaining an inlet air temperature of each indoor unit; obtaining a two-phase saturation temperature of each indoor unit; obtaining an air supply volume of each indoor unit; obtaining a heat exchange area of each indoor unit; and calculating a heat exchange amount of each indoor unit according to the total heat exchange amount of the multi-connection air conditioning system, the inlet air temperature of each indoor unit, the two-phase saturation temperature of each indoor unit, the air supply volume of each indoor unit, and the heat exchange area of each indoor unit.

In a preferred technical solution of the above method for calculating the heat exchange amount of the multi-connection air conditioning system, the step of "calculating the heat exchange amount of each indoor unit according to the total heat exchange amount of the multi-connection air conditioning system, the inlet air temperature of each indoor unit, the two-phase saturation temperature of each indoor unit, the air supply volume of each indoor unit, and the heat exchange area of each indoor unit" specifically includes: calculating a weight coefficient of each indoor unit according to the inlet air temperature of each indoor unit, the two-phase saturation temperature of each indoor unit, the air supply volume of each indoor unit and the heat exchange area of each indoor unit; and calculating the heat exchange amount of each indoor unit according to the total heat exchange amount of the multi-connection air conditioning system and the weight coefficient of each indoor unit.

In a preferred technical solution of the above method for calculating the heat exchange amount of the multi-connection air conditioning system, the step of "calculating the weight coefficient of each indoor unit according to the inlet air temperature of each indoor unit, the two-phase saturation temperature of each indoor unit, the air supply volume of each indoor unit and the heat exchange area of each indoor unit" specifically includes: using the following formula to calculate the weight of each indoor unit: wcal, $i=a_1T_{ain}+a_2T_e+a_3T_{ain}Q_a+a_4T_eQ_a+a_5AT_{ain}Q_a+a_6AT_eQ_a+a_7A+a_8T_eA+a_9$;

wherein $T_{ain}$ is the inlet air temperature of the indoor unit, $T_e$ is the two-phase saturation temperature of the indoor unit, $Q_a$ is the air supply volume of the indoor unit, A is the heat exchange area of the indoor unit, $a_1$ is a first correction coefficient, $a_2$ is a second correction coefficient, $a_3$ is a third correction coefficient, $a_4$ is a fourth correction coefficient, $a_5$ is a fifth correction coefficient, $a_6$ is a sixth correction coefficient, $a_7$ is a seventh correction coefficient, $a_8$ is an eighth correction coefficient, and $a_9$ is a ninth correction coefficient; and obtaining the weight coefficient of each indoor unit by dividing the weight of each indoor unit by the sum of the weights of all the indoor units.

In a preferred technical solution of the above method for calculating the heat exchange amount of the multi-connection air conditioning system, when the multi-connection air-conditioning system is in a cooling operating condition, the step of "obtaining the total heat exchange amount of the multi-connection air-conditioning system" specifically includes: obtaining a flow rate of a compressor of the multi-connection air conditioning system; obtaining a specific enthalpy of a heat exchange medium at an outlet of the outdoor unit of the multi-connection air conditioning system and a specific enthalpy of a heat exchange medium at a suction port of the compressor of the multi-connection air conditioning system; and calculating the total heat exchange amount of the multi-connection air conditioning system according to the flow rate of the compressor of the multi-connection air conditioning system, the specific enthalpy of the heat exchange medium at the outlet of the outdoor unit of the multi-connection air conditioning system, and the specific enthalpy of the heat exchange medium at the suction port of the compressor of the multi-connection air conditioning system.

In a preferred technical solution of the above method for calculating the heat exchange amount of the multi-connection air conditioning system, the total heat exchange amount of the multi-connection air conditioning system is equal to the flow rate of the compressor of the multi-connection air conditioning system multiplied by a difference between the specific enthalpy of the heat exchange medium at the outlet of the outdoor unit of the multi-connection air conditioning system and the specific enthalpy of the heat exchange medium at the suction port of the compressor of the multi-connection air conditioning system.

In a preferred technical solution of the above method for calculating the heat exchange amount of the multi-connection air conditioning system, the flow rate of the compressor of the multi-connection air conditioning system is $m_c=f_r V \rho_c \eta$; wherein $f_r$ is a frequency of the compressor, V is a suction volume of the compressor, $p_c$ is a suction density of the compressor, and $\eta$ is a volumetric efficiency of the compressor.

In a preferred technical solution of the above method for calculating the heat exchange amount of the multi-connection air conditioning system, when the multi-connection air-conditioning system is in a heating operating condition, the step of "obtaining the total heat exchange amount of the multi-connection air-conditioning system" specifically includes: obtaining a flow rate of a compressor of the multi-connection air conditioning system; obtaining a specific enthalpy of a heat exchange medium at a discharge port of the compressor of the multi-connection air conditioning system and a specific enthalpy of a heat exchange medium at an inlet of an electronic expansion valve of the multi-connection air conditioning system; and calculating the total heat exchange amount of the multi-connection air conditioning system according to the flow rate of the compressor of the multi-connection air conditioning system, the specific enthalpy of the heat exchange medium at the discharge port of the compressor of the multi-connection air conditioning system and the specific enthalpy of the heat exchange medium at the inlet of the electronic expansion valve of the multi-connection air conditioning system.

In a preferred technical solution of the above method for calculating the heat exchange amount of the multi-connection air conditioning system, the total heat exchange amount of the multi-connection air conditioning system is equal to the flow rate of the compressor of the multi-connection air conditioning system multiplied by a difference between the specific enthalpy of the heat exchange medium at the discharge port of the compressor of the multi-connection air conditioning system and the specific enthalpy of the heat exchange medium at the inlet of the electronic expansion valve of the multi-connection air conditioning system.

In a preferred technical solution of the above method for calculating the heat exchange amount of the multi-connection air conditioning system, the flow rate of the compressor of the multi-connection air conditioning system is $m_c=f_r V \rho_c \eta$; wherein $f_r$ is a frequency of the compressor, V is a suction volume of the compressor, $\rho_c$ is a suction density of the compressor, and $\eta$ is a volumetric efficiency of the compressor.

The present disclosure also provides a multi-connection air conditioning system. The multi-connection air conditioning system includes a controller, and the controller is capable of performing the method for calculating the heat exchange amount as described in any one of the above preferred technical solutions.

Those skilled in the art can understand that in a preferred technical solution of the present disclosure, the multi-connection air conditioning system of the present disclosure includes a plurality of indoor units, and the method for calculating the heat exchange amount of the present disclosure includes: obtaining a total heat exchange amount of the multi-connection air conditioning system; obtaining an inlet air temperature of each indoor unit; obtaining a two-phase saturation temperature of each indoor unit; obtaining an air supply volume of each indoor unit; obtaining a heat exchange area of each indoor unit; and calculating a heat exchange amount of each indoor unit according to the total heat exchange amount of the multi-connection air conditioning system, the inlet air temperature of each indoor unit, the two-phase saturation temperature of each indoor unit, the air supply volume of each indoor unit, and the heat exchange area of each indoor unit. The method for calculating the heat exchange amount of the present disclosure can calculate the weight of a heat exchange capacity of each indoor unit in the entire multi-connection air-conditioning system according to the inlet air temperature of each indoor unit, the two-phase saturation temperature of each indoor unit, the air supply volume of each indoor unit, and the heat exchange area of each indoor unit; the weights of all the indoor units are added to obtain the total weight of the entire multi-connection air-conditioning system, and a ratio of the weight of each indoor unit and the total weight of all the indoor units can represent a proportion of the heat exchange amount of each indoor unit in the total heat exchange amount of the entire multi-connection air conditioning system; a product of this ratio and the total heat exchange amount of the multi-connection air conditioning system is the heat exchange amount of the indoor unit. In other words, the present disclosure can determine the proportion of the heat exchange amount of each indoor unit in the total heat exchange amount according to the inlet air temperature of each indoor unit, the two-phase saturation temperature of each indoor unit, the air supply volume of each indoor unit, and the heat exchange area of each indoor unit; then, the heat exchange amount of each indoor unit is calculated according to the total heat exchange amount of the multi-connection air conditioning system and the proportions of the heat exchange amounts of the indoor units in the total heat exchange amount. That is, the method for calculating the heat exchange amount of the present disclosure can be used to calculate the heat exchange amount of each indoor unit in an air-cooled multi-connection air conditioning system, so that the user can monitor the heat exchange amount of each indoor unit separately, which further enables the user to manage operations of the indoor units according to the heat exchange amounts of the indoor units. In addition, it can be understood that there are many methods for calculating the total heat exchange amount of the multi-connection air conditioning system, and other basic parameters used in the present disclosure are very easy to obtain in an actual detection process. Thus, a problem that it is difficult to measure a flow rate of gas in the air conditioning system by means of an instrument and thus the heat exchange amount of each indoor unit cannot be calculated separately is effectively overcome, thereby effectively ensuring the accuracy of the basic data. Moreover, the method for calculating the heat exchange amount of the present disclosure calculates the proportion of the heat exchange amount of each indoor unit in the total heat exchange amount through these basic parameters, thereby effectively improving the accuracy of the calculation result of the heat exchange amount of each indoor unit.

Further, in a preferred technical solution of the present disclosure, when the multi-connection air-conditioning system is in a cooling operating condition, the method for calculating the heat exchange amount of the present disclosure can calculate the total heat exchange amount of the multi-connection air conditioning system according to the flow rate of the compressor of the multi-connection air conditioning system, the specific enthalpy of the heat exchange medium at the outlet of the outdoor unit of the multi-connection air conditioning system, and the specific enthalpy of the heat exchange medium at the suction port of the compressor of the multi-connection air conditioning system. It can be understood that the multi-connection air-conditioning system usually has only one outdoor unit, that is, it has only one compressor. Therefore, the present disclosure calculates the total heat exchange amount of the multi-connection air conditioning system by using the flow rate of the compressor, the specific enthalpy of the heat exchange medium at the outlet of the outdoor unit of the multi-connection air conditioning system, and the specific enthalpy of the heat exchange medium at the suction port of the compressor of the multi-connection air conditioning system, which not only can effectively simplify the calculation process of the total heat exchange amount of the multi-connection air conditioning system, but also enables the total heat exchange amount obtained through such a calculation method to have a high accuracy, which further effectively improves the accuracy of the calculation result of the heat exchange amount of each indoor unit.

Further, in a preferred technical solution of the present disclosure, when the multi-connection air-conditioning system is in a heating operating condition, the method for calculating the heat exchange amount of the present disclosure can calculate the total heat exchange amount of the multi-connection air conditioning system according to the flow rate of the compressor of the multi-connection air conditioning system, the specific enthalpy of the heat exchange medium at the discharge port of the compressor of the multi-connection air conditioning system and the specific enthalpy of the heat exchange medium at the inlet of the electronic expansion valve of the multi-connection air conditioning system. It can be understood that the multi-connection air-conditioning system usually has only one outdoor unit, that is, it has only one compressor. Therefore, the present disclosure calculates the total heat exchange amount of the multi-connection air conditioning system by using the flow rate of the compressor of the multi-connection air conditioning system, the specific enthalpy of the heat exchange medium at the discharge port of the compressor of the multi-connection air conditioning system and the specific enthalpy of the heat exchange medium at the inlet of the electronic expansion valve of the multi-connection air conditioning system, which not only can effectively simplify the calculation process of the total heat exchange amount of the multi-connection air conditioning system, but also enables the total heat exchange amount obtained through such a calculation method to have a high accuracy, which further effectively improves the accuracy of the calculation result of the heat exchange amount of each indoor unit.

DETAILED DESCRIPTION

Figure 1:
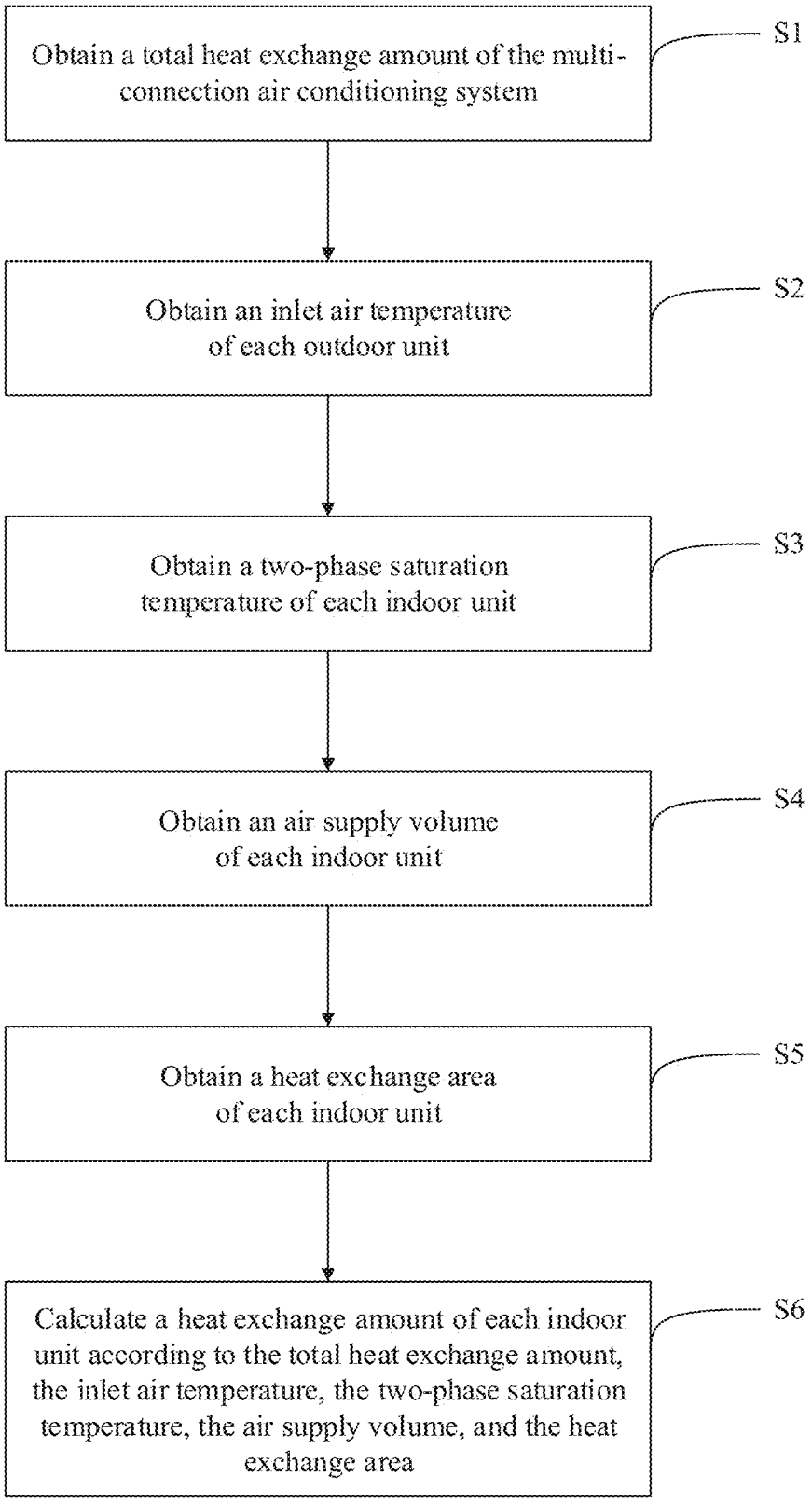
FIG. 1 is a flowchart showing main steps of a method for calculating a heat exchange amount of the present disclosure.

Preferred embodiments of the present disclosure will be described below with reference to the accompanying drawings. It should be understood by those skilled in the art that these embodiments are only used to explain the technical principles of the present disclosure, and are not intended to limit the scope of protection of the present disclosure. For example, although various steps of the method of the present disclosure are described in specific orders in the present application, these orders are not limiting, and those skilled in the art may execute these steps according to different orders without departing from the basic principles of the present disclosure.

It should be noted that in the description of the present disclosure, unless otherwise clearly specified and defined, terms "connect" and "connection" should be understood in a broad sense; for example, the connection may be a fixed connection, or may also be a detachable connection, or an integral connection; it may be a direct connection, or an indirect connection implemented through an intermediate medium, or it may be an internal communication between two elements. For those skilled in the art, the specific meaning of the above terms in the present disclosure can be understood according to specific situations. Terms "first", "second", "third", "fourth", etc. are used for descriptive purposes only, and should not be interpreted as indicating or implying relative importance.

First, it should be noted that, as a preferred embodiment of the present disclosure, the multi-connection air-conditioning system includes one outdoor unit and a plurality of indoor units; of course, the multi-connection air-conditioning system may also include a plurality of outdoor units, and those skilled in the art may set the specific number of indoor units and outdoor units by themselves as actually required. Specifically, in this preferred embodiment, each indoor unit is provided with an intake air temperature sensor, which is capable of measuring an intake air temperature of the indoor unit; of course, the present disclosure does not impose any restrictions on the specific structures and arrangement positions of the intake air temperature sensors, and those skilled in the art may set the structures and positions by themselves as actually required, as long as the multi-connection air conditioning system can detect the inlet air temperature of each indoor unit through the inlet air temperature sensors. The multi-connection air conditioning system further includes a first pressure sensor, a second pressure sensor and a third pressure sensor, as well as a first temperature sensor, a second temperature sensor, a third temperature sensor and a fourth temperature sensor; wherein the first pressure sensor is configured to measure a suction pressure of the compressor, and the first temperature sensor is configured to measure a suction temperature of the compressor; the second pressure sensor is configured to measure a discharge pressure of the compressor, and the second temperature sensor is configured to measure a discharge temperature of the compressor; the third pressure sensor is configured to measure the pressure at an outlet of the outdoor unit, and the third temperature sensor is configured to measure a temperature at the outlet of the outdoor unit; and the fourth temperature sensor is configured to measure a temperature at an inlet of an electronic expansion valve. It should be noted that the present disclosure does not impose any restrictions on the specific structure of the multi-connection air-conditioning system. The multi-connection air-conditioning system can rely on its own sensors to obtain various basic data, or can use external sensors to obtain various basic data, as long as the multi-connection air conditioning system can obtain the basic data required to be used in the method for calculating the heat exchange amount. In addition, it should also be noted that the heat exchange amount in the present disclosure is the heat exchange amount per unit time; that is, when the air conditioning system is in a cooling operating condition, the heat exchange amount refers to a cooling capacity of the air conditioning system, and when the air conditioning system is in a heating operating condition, the heat exchange amount refers to a heating capacity of the air conditioning system.

Further, the multi-connection air-conditioning system further includes a controller, which is capable of obtaining data detected by various sensors, and which is also capable of controlling the operations of various elements, thereby controlling an operating status of the multi-connection air conditioning system. Those skilled in the art can understand that the present disclosure does not impose any restrictions on the specific structure and model of the controller, and the controller may be the original controller of the multi-connection air conditioning system, or it may be a controller provided separately for performing the method for calculating the heat exchange amount of the present disclosure. Those skilled in the art may set the structure and model of the controller by themselves as actually required.

First, reference is made to FIG. 1, which is a flowchart showing main steps of the method for calculating the heat exchange amount of the present disclosure. As shown in FIG. 1, based on the multi-connection air conditioning system described in the above embodiment, the method for calculating the heat exchange amount of the present disclosure mainly includes the following steps:

S1: obtaining a total heat exchange amount of the multi-connection air conditioning system;

S2: obtaining an inlet air temperature of each indoor unit;

S3: obtaining a two-phase saturation temperature of each indoor unit;

S4: obtaining an air supply volume of each indoor unit;

S5: obtaining a heat exchange area of each indoor unit; and

S6: calculating a heat exchange amount of each indoor unit according to the total heat exchange amount of the multi-connection air conditioning system, the inlet air temperature, the two-phase saturation temperature, the air supply volume and the heat exchange area of each indoor unit.

Further, in step S1, the controller can obtain the total heat exchange amount of the multi-connection air conditioning system; it should be noted that the present disclosure does not impose any restrictions on the method for calculating the total heat exchange amount of the multi-connection air conditioning system, and those skilled in the art can calculate the total heat exchange amount of the multi-connection air conditioning system using any calculation method in the related art; that is, those skilled in the art can select the method for calculating the total heat exchange amount by themselves according to the actual situation. Next, in step S2, the controller can obtain the inlet air temperatures of the indoor units through the inlet air temperature sensors separately; of course, this way of obtaining the inlet air temperatures is not limiting, and those skilled in the art may also obtain the inlet air temperature of each indoor unit through other methods. In addition, in step S3, the controller can obtain the two-phase saturation temperature of each indoor unit; it should be noted that the two-phase saturation temperature refers to a temperature at which a gas-liquid two-phase refrigerant reaches a gasification rate and a condensation rate that are equal to each other under a certain pressure. When the multi-connection air conditioning system is in a cooling operating condition, the two-phase saturation temperature can be calculated from the suction pressure of the compressor, and when the multi-connection air conditioning system is in a heating operating condition, the two-phase saturation temperature can be calculated from the discharge pressure of the compressor. Of course, those skilled in the art can also calculate or obtain the two-phase saturation temperature in other ways, as long as the two-phase saturation temperature can be obtained by the controller.

Further, in step S4, the controller can obtain the air supply volume of each indoor unit. It can be understood that the air supply volume of the indoor unit can be calculated from a rotational speed of a fan of the indoor unit. Of course, the air supply volume of the indoor unit can also be inquired from a correspondence table of operating conditions and air supply volumes provided by the manufacturer. That is, the present disclosure does not impose any restrictions on the way that the controller obtains the air supply volume of each indoor unit, and those skilled in the art may set it by themselves as actually required. Next, in step S5, the controller can obtain the heat exchange area of each indoor unit. It should be noted that the heat exchange area of the indoor unit may directly be the data provided by the manufacturer. Of course, those skilled in the art may also measure or calculate the heat exchange area of a heat exchanger of each indoor unit by themselves in other ways. The change of this specific way of obtaining the data does not deviate from the basic principle of the present disclosure and falls within the scope of protection of the present disclosure.

Further, in step S6, the controller can calculate the heat exchange amount of each indoor unit according to the total heat exchange amount of the multi-connection air conditioning system, the inlet air temperature, the two-phase saturation temperature, the air supply volume and the heat exchange area of each indoor unit. It should be noted that the present disclosure does not impose any restrictions on the specific calculation formula for calculating the heat exchange amount of each indoor unit. As long as the calculation formula is used to calculate the heat exchange amount of the indoor unit by using the total heat exchange amount of the multi-connection air conditioning system, the inlet air temperature of each indoor unit, the two-phase saturation temperature of each indoor unit, the air supply volume of each indoor unit and the heat exchange area of each indoor unit, it falls within the scope of protection of the present disclosure. That is, those skilled in the art can set the calculation formula by themselves according to the actual situation of the multi-connection air conditioning system.

Figure 2:
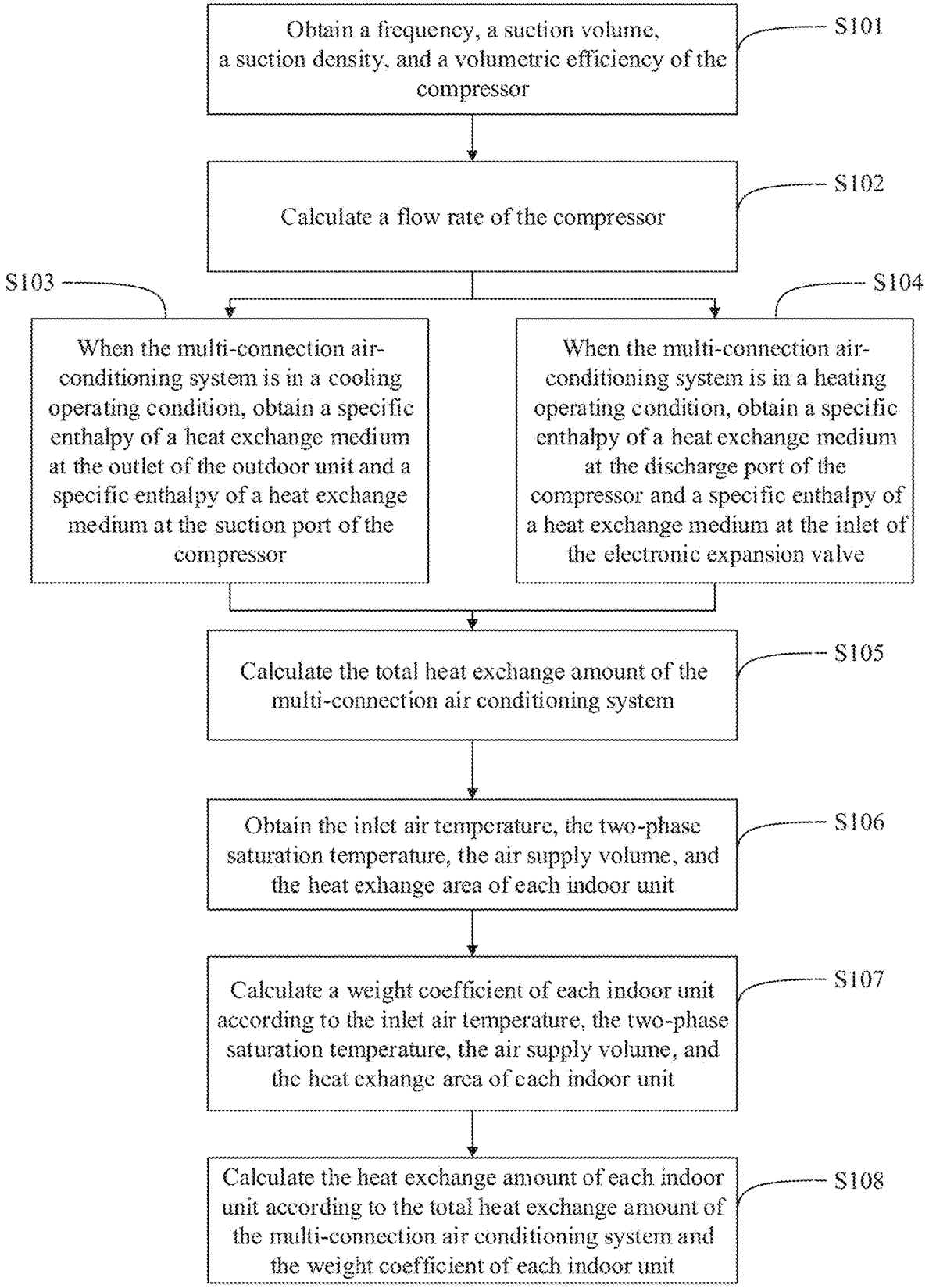
FIG. 2 is a flowchart showing specific steps of a preferred embodiment of the present disclosure.

Hereinafter, reference is made to FIG. 2, which is a flowchart showing specific steps of a preferred embodiment of the present disclosure. As shown in FIG. 2, based on the multi-connection air conditioning system described in the above embodiment, the preferred embodiment of the present disclosure specifically includes the following steps:

S101: obtaining a frequency, a suction volume, a suction density and a volumetric efficiency of the compressor;

S102: calculating a flow rate of the compressor;

S103: when the multi-connection air-conditioning system is in a cooling operating condition, obtaining a specific enthalpy of a heat exchange medium at the outlet of the outdoor unit and a specific enthalpy of a heat exchange medium at the suction port of the compressor;

S104: when the multi-connection air-conditioning system is in a heating operating condition, obtaining a specific enthalpy of a heat exchange medium at the discharge port of the compressor and a specific enthalpy of a heat exchange medium at the inlet of the electronic expansion valve;

S105: calculating the total heat exchange amount of the multi-connection air conditioning system;

S106: obtaining the inlet air temperature, the two-phase saturation temperature, the air supply volume and the heat exchange area of each indoor unit;

S107: calculating a weight coefficient of each indoor unit according to the inlet air temperature, the two-phase saturation temperature, the air supply volume and the heat exchange area of each indoor unit; and S108: calculating the heat exchange amount of each indoor unit according to the total heat exchange amount of the multi-connection air conditioning system and the weight coefficient of each indoor unit.

Further, in step S101, the controller can obtain the frequency $f_r$, the suction volume V, the suction density $\rho_c$ and the volumetric efficiency $\eta$ of the compressor; wherein the frequency $f_r$ and the suction volume V can be obtained from the factory information of the compressor, and the controller can obtain the suction pressure of the compressor through the first pressure sensor, and obtain the suction temperature of the compressor through the first temperature sensor. The compressor can calculate the suction density $\rho_c$ of the compressor from the suction pressure and suction temperature of the compressor, and the volumetric efficiency $\eta$ of the compressor can be fitted by itself based on experimental data. Since the volumetric efficiencies $\eta$ of different compressors are usually different, those skilled in the art need to set the method for calculating the volumetric efficiency $\eta$ by themselves according to the specific conditions of the compressor. In addition, it can be understood by those skilled in the art that the method for obtaining the above parameters described in this embodiment is only a preferred embodiment and is not a restrictive description. Those skilled in the art can also obtain the frequency $f_r$, the suction volume V, the suction density $\rho_c$ and the volumetric efficiency $\eta$ of the compressor in other ways.

Further, in step S102, the controller can calculate the flow rate $m_c$ of the compressor according to the frequency $f_r$, the suction volume V, the suction density $\rho_c$ and the volumetric efficiency $\eta$ of the compressor, wherein the flow rate $m_c$ of the compressor is:

$$m_c = f_r V \rho_c \eta;$$

wherein the unit of the flow rate $m_c$ is kg/s; the unit of the frequency $f_r$ is Hz; the unit of the suction volume V is $m^3$; and the unit of suction density $\rho_c$ is $kg/m^3$.

It should be noted that this calculation method is only exemplary, and those skilled in the art may also set other calculation formulas by themselves according to actual situation; for example, those skilled in the art may also add some correction coefficients to the above calculation formula. The change of this specific calculation method does not deviate from the basic principles of the present disclosure, and falls within the scope of protection of the present disclosure.

Furthermore, in step S103, when the multi-connection air-conditioning system is in the cooling operating condition, the controller can obtain the specific enthalpy hcout of the heat exchange medium at the outlet of the outdoor unit of the multi-connection air-conditioning system and the specific enthalpy hsuc of the heat exchange medium at the suction port of the compressor of the multi-connection air-conditioning system. It should be noted that the outlet of the outdoor unit may be located at any point on a main pipe used when the outdoor unit communicates with the plurality of indoor units, as long as the heat exchange medium flowing out of the outdoor unit has not been divided at such a point. Next, in step S105, the controller can calculate the cooling capacity of the multi-connection air-conditioning system when it is in the cooling operating condition, according to the flow rate $m_c$ of the compressor, the specific enthalpy hcout of the heat exchange medium at the outlet of the outdoor unit of the multi-connection air-conditioning system and the specific enthalpy hsuc of the heat exchange medium at the suction port of the compressor of the multi-connection air-conditioning system:

$$Q_c = m_c(\text{hcout} - \text{hsuc});$$

wherein the unit of the cooling capacity $Q_c$ is W, the unit of the specific enthalpy hcout of the heat exchange medium at the outlet of the outdoor unit is kj/kg, and the unit of the specific enthalpy hsuc of the heat exchange medium at the suction port of the compressor is kj/kg.

It should be noted that this method for calculating the cooling capacity is only exemplary, and those skilled in the art may also set other calculation formulas by themselves according to actual situation; for example, those skilled in the art may also add some correction coefficients to the above calculation formula. The change of this specific calculation method does not deviate from the basic principles of the present disclosure, and falls within the scope of protection of the present disclosure.

Furthermore, in step S104, when the multi-connection air-conditioning system is in the heating operating condition, the controller can obtain the specific enthalpy hdis of the heat exchange medium at the discharge port of the compressor of the multi-connection air conditioning system and the specific enthalpy hval of the heat exchange medium at the inlet of the electronic expansion valve of the multi-connection air conditioning system. It should be noted that the inlet of the electronic expansion valve in this preferred embodiment may be located at any point near the inlet of the electronic expansion valve, as long as the specific enthalpy of the heat exchange medium at this point is close to the specific enthalpy of the heat exchange medium at the inlet of the electronic expansion valve. Next, in step S105, the controller can calculate the heating capacity of the multi-connection air-conditioning system when it is in the heating operating condition, according to the flow rate $m_c$ of the compressor, the specific enthalpy hdis of the heat exchange medium at the discharge port of the compressor of the multi-connection air conditioning system and the specific enthalpy hval of the heat exchange medium at the inlet of the electronic expansion valve of the multi-connection air conditioning system:

$$Q_h = m_c(\text{hdis} - \text{hval});$$

wherein the unit of the heating capacity $Q_h$ is W, the unit of the specific enthalpy hdis of the heat exchange medium at the discharge port of the compressor is kj/kg, and the unit of the specific enthalpy hval of the heat exchange medium at the inlet of the electronic expansion valve is kj/kg.

It should be noted that this method for calculating the heating capacity is only exemplary, and those skilled in the art may also set other calculation formulas by themselves according to actual situation; for example, those skilled in the art may also add some correction coefficients to the above calculation formula. The change of this specific calculation method does not deviate from the basic principles of the present disclosure, and falls within the scope of protection of the present disclosure.

As a way of calculating the specific enthalpy of a gas having a pressure of P and a temperature of T, the specific enthalpy thereof is:

$$h=hvs+a0a1*(T+273.15)/(Ts+273.15)+a2*P/1000)\hat{}2+a4*(T+273.15)/(Ts+273.15)*P/1000+a5*(T+273.15)/(Ts+273.15)\hat{}2+a6*(T+273.15)/(Ts+273.15)\hat{}3$$

wherein the unit of h is kj/kg; the units of T and Ts are ° C.; the unit of P is kPa; a0=−7193.961732; a1=19622.709195; a2=−94.704450; a3=0.389046; a4=94.665122; a5=−17960.594235; a6 =5530.407319; and hvs is the specific enthalpy of saturated gas corresponding to the pressure P:

$$hvs=1.1968310788*10^{-9}*P\hat{}3-1.1117338854*10^{-5}*P\hat{}2+2.8248788070*10^{-2}*P+4.0484133760*10^{2}$$

Ts is the temperature of saturated gas corresponding to the pressure P:

$$Ts-6.45972*10^{-6}p\hat{}2+1.76583*10^{-2}*p-3.58652*10$$

As a way of calculating the specific enthalpy of liquid having a temperature of T, the specific enthalpy thereof is:

$$h=3.52875*10^{-5}*Ps\hat{}3-2.69764*10^{-5}*Ps\hat{}2+9.82272*10^{-2}*Ps+1.35940*10^{2};$$

$$Ps=0.39047T\hat{}2+25.98066T+779.731127;$$

wherein the unit of h is kj/kg; the unit of Ps is kPa; and the unit of T is ° C.

It should be noted that this method for calculating the specific enthalpy of heat exchange medium is only exemplary, and those skilled in the art can also fit other calculation formulas based on actual experimental data; this change in the calculation formula of the specific enthalpy of heat exchange medium does not deviate from the basic principles of the present disclosure, and falls within the scope of protection of the present disclosure.

Further, in step S106, the controller can obtain the inlet air temperature $T_{ain}$ of each indoor unit, the two-phase saturation temperature $T_e$ of each indoor unit, the air supply volume $Q_a$ of each indoor unit, and the heat exchange area A of each indoor unit, and these parameters are obtained in the same way as in the previous embodiment, which will not be repeated herein.

Further, in step S107, the controller can calculate the weight coefficient of each indoor unit according to the inlet air temperature $T_{ain}$ of each indoor unit, the two-phase saturation temperature $T_e$ of each indoor unit, the air supply volume $Q_a$ of each indoor unit, and the heat exchange area A of each indoor unit. Specifically, the calculation formula of the weight wcal, i of each indoor unit is as follows:

$$\text{wcal},i=a_1T_{ain}+a_2T_e+a_3T_{ain}Q_a+a_4T_eQ_a+a_5AT_{ain}Q_a+a_6AT_eQ_a+a_7A+a_8T_eA+a_9;$$

wherein the unit of the inlet air temperature $T_{ain}$ is ° C.; the unit of the two-phase saturation temperature $T_e$ is ° C.; the unit of the air supply volume $Q_a$ is $m^3/s$; and the unit of the heat exchange area A is $m^2$. At the same time, $a_1$ is a first correction coefficient, $a_2$ is a second correction coefficient, $a_3$ is a third correction coefficient, $a_4$ is a fourth correction coefficient, $a_5$ is a fifth correction coefficient, $a_6$ is a sixth correction coefficient, $a_7$ is a seventh correction coefficient, $a_8$ is an eighth correction coefficient, and $a_9$ is a ninth correction coefficient. After fitting several sets of experimental data, the following set of exemplary correction coefficients is obtained: $a_1$=0.0897, $a_2$=0.0273, $a_3$=0.0172, $a_4$=−0.0013, $a_5$=−0.0018, $a_6$=0.0029, $a_7$=0.7745, $a_8$=−2.2052, and $a_9$=0.0500. It should be noted that this specific set of data is only exemplary. Since the specific structures of the air-conditioning systems are different, for different air-conditioning systems, each correction coefficient may be different. In other words, those skilled in the art need to set the specific value of each correction coefficient by themselves according to the actual conditions of different air-conditioning systems. Those skilled in the art can obtain these correction coefficients by fitting the experimental data, and can also determine these correction coefficients through computer modeling. After these correction coefficients are determined, the controller can calculate the weight of each indoor unit in the multi-connection air conditioning system separately according to the above formula.

In the following, the basis of the calculation formula of the weight wcal, i of each indoor unit will be described; since a unit heat exchange amount of the heat exchanger is:

$$Q=\alpha A\Delta T;$$

wherein a is the heat exchange coefficient, A is the heat exchange area, and ΔT is heat exchange temperature difference, and $$\alpha=f(Q_a)\approx(aQ_a+b),$$

wherein $Q_a$ is the air supply volume, and a and b are both empirical coefficients; and $$\Delta T=\left(T_e-\frac{T_{ain}+T_{aout}}{2}\right),$$

wherein $T_e$ is the two-phase saturation temperature of the heat exchange medium, $T_{ain}$ is the inlet air temperature of the indoor unit, and $T_{aout}$ is the outlet air temperature of the indoor unit;

in summary;

$$Q=(aQ_a+b)A\left(T_e-\frac{T_{ain}+T_{aout}}{2}\right);$$

wherein $T_{aout}$ is an unknown term, and is subject to the equation:

$$Q=\rho Q_a(\text{hair, out}-\text{hair, in})$$

wherein ρ is the density of air, hair, out is the specific enthalpy of the outlet air, and hair, in is the specific enthalpy of the inlet air; and $$\text{hair,out}=f(T_{aout})$$

$$\text{hair,in}=f(T_{ain})$$

In summary, the weight wcal, i of each indoor unit can be expressed as:

$$wcal,\ i=Q/Q_t=(aQ_a+b)A\left(T_e-\frac{T_{ain}+T_{aout}}{2}\right)/Q_t;$$

wherein $Q_t$ is the total heat exchange amount of the multi-connection air conditioning system, $T_{aout}$ is an implicit term, and the value of $T_{aout}$ can be calculated by the linear equations of $T_{ain}$, $T_e$ and $Q_a$. By synthesizing the above formulas and omitting some terms that may be ignored, the weight wcal, i can be infinitely approximated by a linear equation, namely:

$$\text{wcal},i = a_1T_{ain}+a_2T_e+a_3T_{ain}Q_a+a_5AT_{ain}Q_a+a_6AT_eQ_a+{}_7A+a_8\,T_e\,A+a_9$$

After the weight of each indoor unit is calculated, the weights of all the indoor units can be added to obtain the total weight of the entire multi-connection air conditioning system. The weight coefficient of each indoor unit is:

$$Pi = \frac{wcal,\,i}{\sum_{i=1}^{N} wcal,\,i};$$

wherein n is the total number of indoor units.

Further, in step S108, when the multi-connection air conditioning system is in the cooling operating condition, the cooling capacity of each indoor unit is:

$$Q_{ci} = Q_c * \frac{wcal,\,i}{\sum_{i=1}^{N} wcal,\,i};$$

wherein the unit of $Q_{ci}$ is W.

Further, in step S108, when the multi-connection air conditioning system is in the heating operating condition, the heating capacity of each indoor unit is:

$$Q_{hi} = Q_h * \frac{wcal,\,i}{\sum_{i=1}^{N} wcal,\,i};$$

wherein the unit of $Q_{hi}$ is W.

Finally, it should be noted that the above embodiments are all preferred implementations of the present disclosure, and are not intended to limit the scope of protection of the present disclosure. When those skilled in the art actually apply the present disclosure, some of the steps may be added or deleted appropriately as required, or the orders between different steps may be exchanged. Such changes do not go beyond the basic principles of the present disclosure, and fall within the scope of protection of the present disclosure.

Hitherto, the preferred embodiments of the present disclosure have been described in conjunction with the accompanying drawings, but it is easily understood by those skilled in the art that the scope of protection of the present disclosure is obviously not limited to these specific embodiments. Without departing from the principle of the present disclosure, those skilled in the art can make equivalent changes or replacements to relevant technical features, and the technical solutions after these changes or replacements will fall within the scope of protection of the present disclosure.

What is claimed is:

1. A method for calculating a heat exchange amount of a multi-connection air conditioning system, the multi-connection air conditioning system comprising a plurality of indoor units, and the method for calculating the heat exchange amount comprises:

obtaining a total heat exchange amount of the multi-connection air conditioning system;

obtaining an inlet air temperature of each indoor unit;

obtaining a two-phase saturation temperature of each indoor unit;

obtaining an air supply volume of each indoor unit;

obtaining a heat exchange area of each indoor unit; and calculating a heat exchange amount of each indoor unit according to the total heat exchange amount of the multi-connection air conditioning system, the inlet air temperature of each indoor unit, the two-phase saturation temperature of each indoor unit, the air supply volume of each indoor unit, and the heat exchange area of each indoor unit; and controlling an operating status of the multi-connection air conditioning system by controlling the operation of at least one element via a controller communicatively coupled to at least one sensor.

2. The method for calculating the heat exchange amount according to claim 1, wherein the calculating of the heat exchange amount of each indoor unit according to the total heat exchange amount of the multi-connection air conditioning system, the inlet air temperature of each indoor unit, the two-phase saturation temperature of each indoor unit, the air supply volume of each indoor unit, and the heat exchange area of each indoor unit comprise:

calculating a weight coefficient of each indoor unit according to the inlet air temperature of each indoor unit, the two-phase saturation temperature of each indoor unit, the air supply volume of each indoor unit and the heat exchange area of each indoor unit; and calculating the heat exchange amount of each indoor unit according to the total heat exchange amount of the multi-connection air conditioning system and the weight coefficient of each indoor unit.

3. The method for calculating the heat exchange amount according to claim 2, wherein the calculating of the weight coefficient of each indoor unit according to the inlet air temperature of each indoor unit, the two-phase saturation temperature of each indoor unit, the air supply volume of each indoor unit and the heat exchange area of each indoor unit comprise:

using the following formula to calculate the weight of each indoor unit:

$$\text{wcal},i=a_1T_{ain}+a_2T_e+a_3T_{ain}Q_a+a_5AT_{ain}Q_a+a_6AT_eQ_a+{}_7A+a_8\,T_e\,A+a_9;$$

wherein $T_{ain}$ is the inlet air temperature of the indoor unit, $T_e$ is the two-phase saturation temperature of the indoor unit, $Q_a$ is the air supply volume of the indoor unit, A is the heat exchange area of the indoor unit, $a_1$ is a first correction coefficient, $a_2$ is a second correction coefficient, $a_3$ is a third correction coefficient, $a_4$ is a fourth correction coefficient, as is a fifth correction coefficient, $a_6$ is a sixth correction coefficient, $a_7$ is a seventh correction coefficient, $a_8$ is an eighth correction coefficient, and $a_9$ is a ninth correction coefficient; and obtaining the weight coefficient of each indoor unit by dividing the weight of each indoor unit by the sum of the weights of all the indoor units.

4. The method for calculating the heat exchange amount according to claim 1, wherein when the multi-connection air-conditioning system is in a cooling operating condition, the obtaining of the total heat exchange amount of the multi-connection air-conditioning system comprises:

obtaining a flow rate of a compressor of the multi-connection air conditioning system;

obtaining a specific enthalpy of a heat exchange medium at an outlet of the outdoor unit of the multi-connection air conditioning system and a specific enthalpy of a heat exchange medium at a suction port of the compressor of the multi-connection air conditioning system; and calculating the total heat exchange amount of the multi-connection air conditioning system according to the flow rate of the compressor of the multi-connection air conditioning system, the specific enthalpy of the heat exchange medium at the outlet of the outdoor unit of the multi-connection air conditioning system, and the specific enthalpy of the heat exchange medium at the suction port of the compressor of the multi-connection air conditioning system.

5. The method for calculating the heat exchange amount according to claim 4, wherein the total heat exchange amount of the multi-connection air conditioning system is equal to the flow rate of the compressor of the multi-connection air conditioning system multiplied by a difference between the specific enthalpy of the heat exchange medium at the outlet of the outdoor unit of the multi-connection air conditioning system and the specific enthalpy of the heat exchange medium at the suction port of the compressor of the multi-connection air conditioning system.

6. The method for calculating the heat exchange amount according to claim 5, wherein the flow rate of the compressor of the multi-connection air conditioning system is $m_c=f_rV\rho_c\eta$; wherein $f_r$ is a frequency of the compressor, V is a suction volume of the compressor, $\rho_c$ is a suction density of the compressor, and $\eta$ is a volumetric efficiency of the compressor.

7. The method for calculating the heat exchange amount according to claim 1, wherein when the multi-connection air-conditioning system is in a heating operating condition, and the obtaining of the total heat exchange amount of the multi-connection air-conditioning system comprises:

obtaining a flow rate of a compressor of the multi-connection air conditioning system;

obtaining a specific enthalpy of a heat exchange medium at a discharge port of the compressor of the multi-connection air conditioning system and a specific enthalpy of a heat exchange medium at an inlet of an electronic expansion valve of the multi-connection air conditioning system; and calculating the total heat exchange amount of the multi-connection air conditioning system according to the flow rate of the compressor of the multi-connection air conditioning system, the specific enthalpy of the heat exchange medium at the discharge port of the compressor of the multi-connection air conditioning system and the specific enthalpy of the heat exchange medium at the inlet of the electronic expansion valve of the multi-connection air conditioning system.

8. The method for calculating the heat exchange amount according to claim 7, wherein the total heat exchange amount of the multi-connection air conditioning system is equal to the flow rate of the compressor of the multi-connection air conditioning system multiplied by a difference between the specific enthalpy of the heat exchange medium at the discharge port of the compressor of the multi-connection air conditioning system and the specific enthalpy of the heat exchange medium at the inlet of the electronic expansion valve of the multi-connection air conditioning system.

9. The method for calculating the heat exchange amount according to claim 8, wherein the flow rate of the compressor of the multi-connection air conditioning system is $m_c=f_rV\rho_c\eta$ wherein $f_r$ is a frequency of the compressor, V is a suction volume of the compressor, $\rho_c$ is a suction density of the compressor, and $\eta$ is a volumetric efficiency of the compressor.

10. A multi-connection air conditioning system, comprising a controller which is capable of performing the method for calculating the heat exchange amount according to claim 1.

* * * * *